US009561532B2

(12) United States Patent
Takamura et al.

(10) Patent No.: US 9,561,532 B2
(45) Date of Patent: Feb. 7, 2017

(54) ROLL FORMING DEVICE

(71) Applicants: Tomoyuki Takamura, Kariya (JP); Keiji Hashimoto, Kariya (JP)

(72) Inventors: Tomoyuki Takamura, Kariya (JP); Keiji Hashimoto, Kariya (JP)

(73) Assignee: Toyota Shatai Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/423,861

(22) PCT Filed: Mar. 7, 2014

(86) PCT No.: PCT/JP2014/056049

§ 371 (c)(1),
(2) Date: Feb. 25, 2015

(87) PCT Pub. No.: WO2014/171221

PCT Pub. Date: Oct. 23, 2014

(65) Prior Publication Data

US 2015/0190854 A1 Jul. 9, 2015

(30) Foreign Application Priority Data

Apr. 15, 2013 (JP) ..... 2013-084798

(51) Int. Cl.
*B21B 27/02* (2006.01)
*B21D 28/12* (2006.01)
(Continued)

(52) U.S. Cl.
CPC ..... *B21B 27/02* (2013.01); *B21D 28/12* (2013.01); *B21D 31/043* (2013.01); *B21H 7/00* (2013.01)

(58) Field of Classification Search
CPC ..... B21B 15/0007; B21B 27/00; B21B 27/02; B21B 27/021; B21B 27/022; B21B 27/032; B21H 8/00; B21H 8/02; B21D 13/04; B21D 13/045; B21D 31/043; F16C 13/00; B23D 19/06
(Continued)

(56) References Cited

U.S. PATENT DOCUMENTS 304,417 A * 9/1884 Fletcher ..... B29C 51/18 112/270
475,700 A * 5/1892 Ohl ..... B21D 13/04 232/8
(Continued)

FOREIGN PATENT DOCUMENTS

JP 61-020632 1/1986
JP H03204126 9/1991
(Continued)

OTHER PUBLICATIONS

International Search Report Cited in PCT/JP2014/056049, with English Translation, Mailed Apr. 22, 2014, 5 Pgs.
(Continued)

*Primary Examiner* — Edward Tolan
(74) *Attorney, Agent, or Firm* — Patterson Thuente Pedersen, P.A.

(57) ABSTRACT

A first roll (20) and a second roll (40) of a roll forming device are provided with a plurality of stacked cutting blades (22, 122) and retainers (21, 121). The retainers (21, 121) pass through the stacked cutting blades (22, 122) and receive a first rotating shaft (16) and a second rotating shaft (18). Projections (21*a*, 121*a*) are formed on end portions of the retainers (21, 121). When the cutting blades (22, 122) are stacked, the projections (21*a*, 121*a*) control positioning operation of the cutting blades (22, 122). With this constitution, when the cutting blades (22, 122) are joined in a stacked state to the retainers (21, 121), the cutting blades
(Continued)

(22, 122) in the stacking direction is controlled with the retainers (21, 121).

3 Claims, 16 Drawing Sheets

(51) Int. Cl.
*B21D 31/04* (2006.01)
*B21H 7/00* (2006.01)

(58) Field of Classification Search
USPC ..... 492/40; 241/295; 83/425.2, 500, 503
See application file for complete search history.

(56) References Cited

U.S. PATENT DOCUMENTS 776,796 A * 12/1904 Perkins ..... B65H 27/00 16/45
1,074,473 A * 9/1913 Shepperd ..... D01B 1/06 19/53
1,428,142 A * 9/1922 Canda ..... B21B 27/035 492/1
1,665,349 A 4/1928 Gersman et al.
2,226,777 A * 12/1940 Martin ..... F16B 21/16 403/217
2,253,718 A * 8/1941 McKeage ..... B31F 1/2822 156/207
2,428,965 A * 10/1947 Frisco ..... B05C 1/165 118/223
2,579,906 A * 12/1951 Cook ..... A01F 11/06 100/155 R
2,690,752 A * 10/1954 Lakin ..... A01D 45/026 241/294
4,275,631 A * 6/1981 Wingen ..... B23D 19/08 83/501
4,584,861 A * 4/1986 Bartilson ..... B21H 7/14 492/1
4,614,632 A * 9/1986 Kezuka ..... B29C 51/08 264/280
4,922,778 A * 5/1990 Nagai ..... B23D 19/04 83/344
5,155,910 A * 10/1992 Henseler ..... B05C 11/025 29/895.21
6,843,761 B1 * 1/2005 Uchida ..... B28B 21/04 29/895.213
7,086,730 B2 * 8/2006 Aoki ..... B41J 13/02 271/109
7,113,725 B2 * 9/2006 Ogashiwa ..... G03G 15/1665 399/121
7,131,295 B2 * 11/2006 Andou ..... C03B 23/0254 492/16
2002/0049124 A1 * 4/2002 Jager ..... A01D 23/02 492/40
2005/0282692 A1 * 12/2005 Redden ..... B65G 39/06 492/40
2006/0287179 A1 * 12/2006 Gleizer ..... B21B 27/035 492/47

FOREIGN PATENT DOCUMENTS

JP 4-12326 1/1992
JP 11-267766 A 10/1999
JP 2006-075900 A 3/2006

OTHER PUBLICATIONS

International Preliminary Report on Patentability for International Application No. PCT/JP2014/056049, filed Mar. 7, 2014, mailed Oct. 20, 2015 (7 pgs.).

* cited by examiner

ROLL FORMING DEVICE

RELATED APPLICATIONS

The present application is a National Phase entry of PCT Application No. PCT/JP2014/056049, filed Mar. 7, 2014, which application claims priority to Japanese Application No. 2013-084798, filed Apr. 15, 2013, both of said applications being hereby incorporated by reference in their entirety.

BACKGROUND OF THE INVENTION

The present invention relates to a roll forming device.

A solid polymer fuel cell is formed of a stack of multiple single cells. The single cell has a separator forming a hydrogen flow passage, a fuel electrode, a solid polymer membrane, an air electrode, and a separator forming an air flow passage. These separators are required to have conductivity and mechanical strength and are formed of a conductive metal plate, for example. The plate is formed into a shape with projections and recesses and this shape with projections and recesses is used to form the hydrogen or air flow passage.

Japanese Laid-Open Patent Publication No. 2006-75900 describes a roll forming device that forms the aforementioned metallic plate into a shape with projections and recesses. According to a die roll described in Japanese Laid-Open Patent Publication No. 2006-75900, grooves having projections and recesses are formed to extend along the entire circumference of each of upper and lower rolls. The projections or the projections and recesses of the lower roll are fitted in between the projections or the projections and recesses of the upper roll. According to Japanese Laid-Open Patent Publication No. 2006-75900, for positioning the upper and lower rolls, an elastic member such as an air spring or rubber is provided in the direction of the thrust of a bearing provided to one or both sides of at least one of these rolls. This allows the respective centers of the projections and recesses of one roll to agree with those of the other roll, thereby avoiding misalignment between the rolls.

Japanese Patent No. 2568285 uses a roll forming device as a device for manufacturing an expanded mesh sheet. According to Japanese Patent No. 2568285, each of an upper roll and a lower roll is formed by stacking multiple disk-shaped cutters at predetermined intervals. Multiple projections are formed at a predetermined pitch along the periphery of each of the disk-shaped cutters.

If a roll of a roll forming device is to be formed by stacking disk-shaped cutters (hereinafter referred to as cutting blades), multiple cutting blades 22 may be stacked on each tubular retainer 21 as shown in FIG. 7, and the retainer 21 with the stacked cutting blades 22 may be assembled by allowing a rotary shaft 16 (not shown) to pass through the retainer 21. In this case, the thickness in the stacking direction of the cutting blades 22 is controlled for each retainer 21.

SUMMARY OF THE INVENTION

As shown in FIG. 7, however, before mounting of the cutting blades 22, there is nothing to regulate the condition of the cutting blades 22 stacked in a large number of layers, so that the cutting blades may move to go out of the range of the retainer. The example of FIG. 7 may cause some of the stacked cutting blades fitted to the retainer 21 to come off. Separation of a cutting blade from the retainer disables control of the thickness in the stacking direction of the cutting blades with the retainer.

Accordingly, it is an objective of the present invention to provide a roll forming device that is capable of easily controlling a stacking direction of multiple cutting blades with a retainer while the cutting blades in layers are fitted to the retainer.

To achieve the foregoing objective and in accordance with one aspect of the present invention, a roll forming device including a plurality of stacked cutting blades is provided. The roll forming device roll-forms a workpiece by rotating a pair of rolls each attached to corresponding one of a pair of rotary shafts. Each of the rolls includes a corresponding number of the stacked cutting blades and a retainer, which allows the corresponding rotary shaft to pass through and extends through the cutting blades. The retainer has at an end portion a controlling portion for controlling positioning of the cutting blades during stacking of the cutting blades.

The controlling portion may function as a preventing portion that prevents the cutting blades from coming off the retainer during stacking of the cutting blades. The preventing portion may be one of a plurality of preventing portions separated from each other.

Each of the preventing portions may be a projecting portion projecting from an end surface of the retainer.

The retainer may be one of a plurality of retainers adjacent to each other, and each of the projecting portions may be formed integrally with an end surface of a corresponding retainer and is received in a receiving portion provided to an adjacent retainer.

The retainer may be one of a plurality of retainers adjacent to each other, each of the projecting portions may be a movable projection supported in a manner that allows the movable projection to project from an end surface of each retainer. When the retainers are adjacent to each other, each movable projection may be pressed by an adjacent retainer and be received in the associated retainer.

The retainer may be one of a plurality of retainers adjacent to each other. The controlling portion may be formed of a position controlling cutting blade located between adjacent two of the retainers, and the position controlling cutting blade limits the positions of the cutting blades on each retainer.

The position controlling cutting blade may be fixed to an end surface of the retainer.

The position controlling cutting blade may be fixed to the retainer with an adhesive.

The retainer may have a recess into which escapes a residue of the adhesive that is caused when the position controlling cutting blade is adhered to the end surface of the retainer.

The position controlling cutting blade may be fastened to the end surface of the retainer with a fastening member.

The fastening member may be a screw buried such that a head of the screw does not project relative to the position controlling cutting blade.

The fastening member may be a bolt with a head projecting relative to the position controlling cutting blade, and the projecting head may be received in a head receiving portion provided to an end surface of an adjacent retainer.

A projecting portion projecting from an end surface of the retainer may pass through the position controlling cutting blade, and a tip of the projecting portion may be received in a receiving portion provided to an end surface of an adjacent retainer.

The present invention achieves the excellent effect of facilitating control of a stacking direction of multiple cutting blades with a retainer while the cutting blades in layers are fitted to the retainer.

DETAILED DESCRIPTION OF THE PREFERRED EMBODIMENTS

Configuration of First Embodiment

A roll forming device according to a first embodiment of the present invention will now be described with reference to FIGS. 1 to 6.

Figure 1:
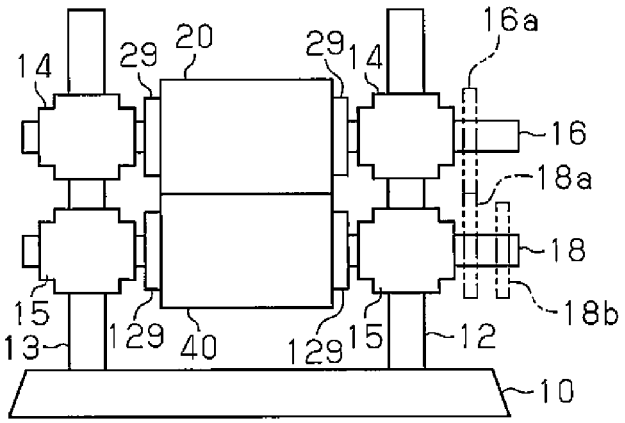
FIG. 1 is a schematic diagram of a roll forming device according to a first embodiment of the present invention.

As shown in FIG. 1, the roll forming device includes a base 10, a pair of side walls 12 and 13 standing upright on the base 10, a first rotary shaft 16, a second rotary shaft 18, a first roll 20 fixed to the first rotary shaft 16, and a second roll 40 fixed to the second rotary shaft 18 to face the first roll 20.

The first and second rotary shafts 16 and 18 are supported on a pair of bearings 14 and a pair of bearings 15, respectively, such that the first and second rotary shafts 16 and 18 are rotational relative to the side walls 12 and 13. The first and second rotary shafts 16 and 18 are arranged parallel to each other. The first rotary shaft 16 has one end connected to a gear 16*a*, and the second rotary shaft 18 has one end connected to a gear 18*a* in meshing engagement with the gear 16*a*. A sprocket 18*b* is fixed to this end of the second rotary shaft 18.

The sprocket 18*b* is rotationally driven by an electric motor (not shown) via an endless chain (not shown) looped over the sprocket 18*b*. The rotations of the sprocket 18*b* and the gears 16*a* and 18*a* rotate the first and second rotary shafts 16 and 18 in synchronization with each other at the same speed.

The first and second rolls 20 and 40 have the same structure. Therefore, the structure of the first roll 20 will be described below and the structure of the second roll 40, and components associated with the second roll 40 are given numbers obtained by adding "100" to the corresponding numbers of each structure of the first roll 20 and components associated with the first roll 20. This applies to other embodiments except the first embodiment.

Figure 2:
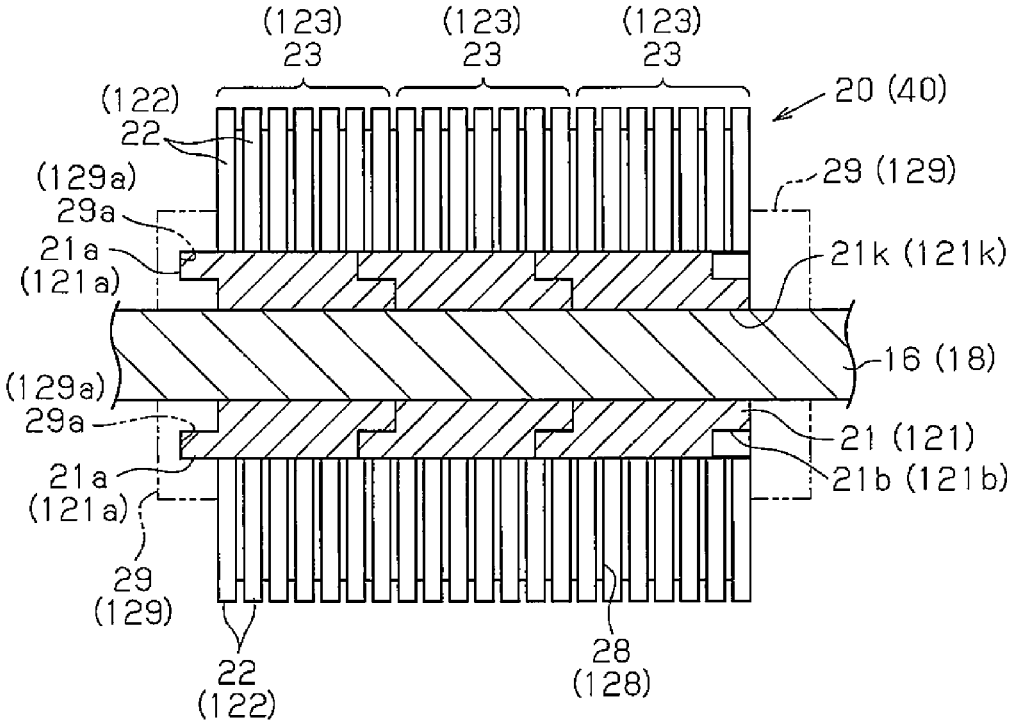
FIG. 2 is a vertical cross-sectional view of a first roll (second roll) of the first embodiment.

As shown in FIG. 2, the first roll 20 includes multiple cutting blade groups 23 each with stacked cutting blades 22 of a predetermined number and stacked spacers 28 of a predetermined number. These cutting blade groups 23 are attached via corresponding multiple retainers 21 to the first rotary shaft 16. Each cutting blade 22 is made of hard metal such as alloy tool steel (SKD) or high-speed tool steel (SKH) or cemented carbide, and is formed into a substantially ring shape. Three cutting blade groups 23 are provided in the present embodiment. Alternatively, the number of the cutting blade groups 23 may be two or four or more.

Figure 4A:
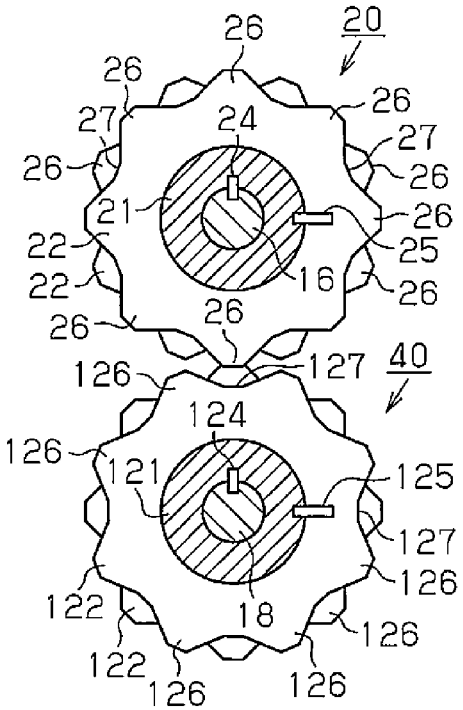
FIG. 4A is a schematic cross-sectional view of the roll forming device of the first embodiment.
Figure 4B:
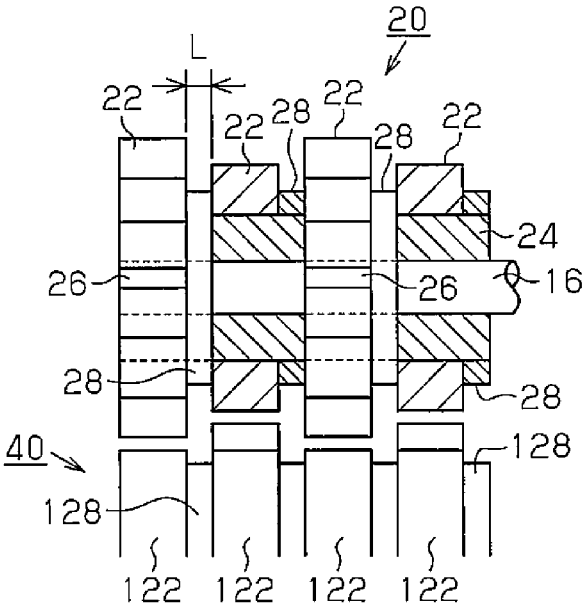
FIG. 4B is an explanatory diagram of a shear clearance in the roll forming device of the first embodiment.

As shown in FIGS. 4A and 4B, each retainer 21 has a shaft hole 21*k* that allows the first rotary shaft 16 to pass through. Each retainer 21 is made of metal and formed into a cylindrical shape. Each retainer 21 is arranged coaxially with the first rotary shaft 16 passing through the shaft hole 21*k*. Each retainer 21 is fixed to the first rotary shaft 16 with a key 24 in a manner that restricts rotation of the retainer 21.

Further, as shown in FIG. 2, the retainers 21 are arranged to tightly contact each other. An axial length S of each retainer 21 is determined to be within a predetermined tolerance range.

Figure 6:
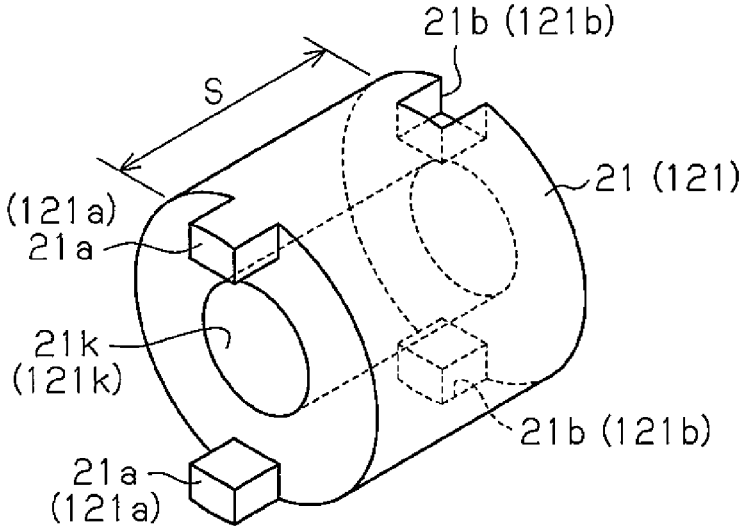
FIG. 6 is a perspective view of the retainer of the first embodiment.
Figure 7:
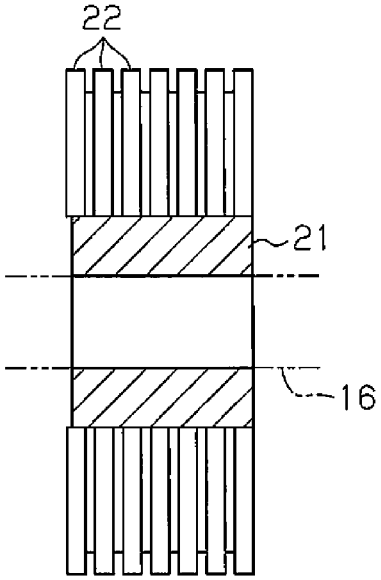
FIG. 7 is a vertical cross-sectional view of a conventional retainer and cutting blades.

As shown in FIG. 6, the axial length S of the retainer 21 and a retainer 121 is the length of a part where a projection 21*a* and a projection 121*a*, and a receiving portion 21*b* and a receiving portion 121*b* are not formed. The length of the projections 21*a* and 121*a* is determined to prevent the cutting blades 22 and the spacers 28 from coming off the retainer 21 even if the thickness of a stack formed by allowing the retainer 21 to pass through the cutting blades 22 and the spacers 28 forming the cutting blade group 23 and stacking the cutting blades 22 and the spacers 28 alternately becomes greater than the axial length S due to fine warp of the cutting blades 22 and the spacers 28 and accumulation of tiny gaps.

The projections 21*a* and 121*a* each correspond to a projecting portion. As shown in FIG. 6, multiple projections 21*a* project from one end surface of the retainer 21 to extend in the direction of the axial length of the first or second rotary shaft 16 or 18. The outer surface of each projection 21*a* is formed to have the same radius of curvature as the outer circumferential surface of the retainer 21.

For illustrative purposes, FIG. 6 does not include a key groove for the key 24 or that for a key 25 shown in FIG. 4A. These key grooves can be formed in any positions irrespective of the positions of the projections 21*a*. If the key groove for the key 25 is formed in the outer surface of one of the multiple projections 21*a*, an opening end of the key groove is formed at an end surface of this projection 21*a*.

As shown in FIG. 6, the receiving portion 21*b* is formed in an end surface of the retainer 21 opposite to the end surface where the projection 21*a* is formed. This receiving portion 21*b* receives the projection 21*a* of an adjacent retainer 21. In the present embodiment, the receiving portion 21*b* has a size that allows the projection 21*a* to fit in the receiving portion 21*b* and is formed into a groove. However, the shape of the receiving portion 21*b* is not limited, but the size thereof is simply required to receive the projection 21*a*.

In the present embodiment, two projections 21*a* are formed at positions separated by 180 degrees in an end surface of the retainer 21. The positions of these projections 21*a* are not limited. Meanwhile, placing a pair of projections 21*a* at positions separated by 180 degrees in the end surface allows the multiple cutting blades 22 to be arranged more stably relative to the retainer 21 and enhances the function of preventing separation while these cutting blades 22 are stacked and assembled, compared to placing the projections 21*a* at different positions. Three or more projections 21*a* may be provided. In this case, it is preferable that all the projections 21*a* be arranged at a regular pitch. One projection 21*a* may be provided. In this case, a longer length of the outer surface of the projection 21*a* in the circumferential direction allows the multiple cutting blades 22 to be arranged more stably while these cutting blades 22 are stacked and assembled, compared to a shorter length thereof.

As shown in FIG. 1, a pair of collars 29 is fixed to the first rotary shaft 16. Each collar 29 abuts on an end portion of one of the retainers 21, which is arranged in the vicinity of the corresponding bearing 14. Each collar 29 is made of metal and formed into a cylindrical shape. Each collar 29 is fitted to the first rotary shaft 16 to allow the first rotary shaft 16 to pass through and is fixed to the first rotary shaft 16 for example with a screw (not shown). Each collar 29 is used to determine the position of each retainer 21 relative to the first rotary shaft 16. In FIG. 2, the collars 29 are shown by long dashed double-short dashed lines. Further, collars 129 are used to determine the position of the retainer 121 of the second roll 40.

Figure 5:
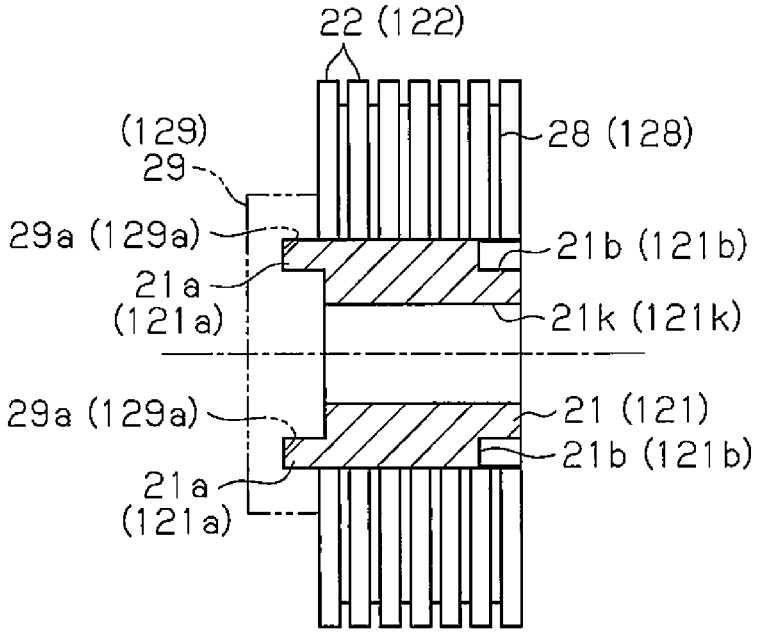
FIG. 5 is a schematic cross-sectional view of a retainer and cutting blades of the first embodiment.

As shown in FIGS. 2 and 5, one of the two collars 29 that faces the projection 21*a* has an end surface provided with a receiving groove 29*a*. Like the receiving portion 21*b*, the receiving groove 29*a* receives this projection 21*a*. As shown in FIG. 4A, the multiple cutting blades 22 forming the cutting blade group 23 are fitted to the outer circumference of the retainer 21 and are coupled in a manner that restricts rotation with the key 25 while allowing movement in the direction of the axial length. Each collar 29 restricts movement of a cutting blade 22 toward a corresponding bearing 14 that belongs to the cutting blades 22 attached to each retainer 21 of the first roll 20 and is closest to this bearing 14.

Regarding each retainer 21, the number of the cutting blades 22 and that of the spacers 28 in the cutting blade group 23 are determined such that the cutting blade group 23 falls within the axial length S of the retainer 21. All the retainers 21 may have the same axial length S or different axial lengths S. In the present embodiment, the axial lengths S of the retainers 21 are set identical.

As shown in FIG. 4A, multiple cutting parts 26 and multiple recesses 27 are formed alternately at a predetermined pitch along the outer circumference of the cutting blade 22. Two cutting blades 22 adjacent to each other in the direction of the axial length are arranged such that their respective cutting parts 26 are shifted from each other by half this predetermined pitch.

Figure 3:
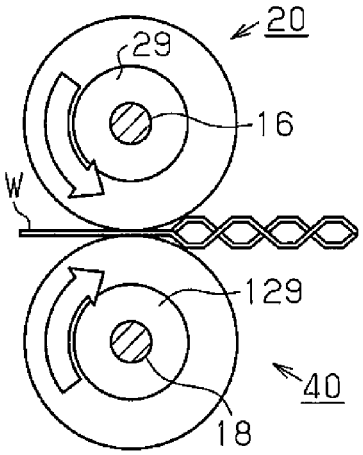
FIG. 3 is an explanatory diagram of forming of a plate by the roll forming device of the first embodiment.

As shown in FIG. 3, for press forming (roll forming) of a workpiece W formed of a metal plate, the positions of the cutting blade 22 of the first roll 20 and that of the cutting blade 122 of the second roll 40 are determined relative to each other such that the cutting part 26 of the cutting blade 22 goes into the recess 127 of the cutting blade 122 as shown in FIG. 4A.

As shown in FIGS. 4A and 4B, with a cutting part 26 of the cutting blade 22 of the first roll 20 inside a recess 127 of the cutting blade 122 of the second roll 40, a shear clearance L is provided between a different cutting blade 122 of the second roll 40 adjacent to the cutting blade 122 with the first recess 127 and the first cutting blade 22 of the first roll 20. Specifically, as shown in FIG. 4B, for formation of the shear clearance L, the ring-shaped spacers 28 and 128 are arranged between adjacent two cutting blades 22 and between adjacent two cutting blades 122, respectively.

The spacers 28 and 128 of the present embodiment are made of metal. However, the material of the spacers 28 and 128 is not limited. The shear clearance L is set according to the material and the thickness of the workpiece W. The shear clearance L suppresses the occurrence of burrs during shearing and provides stable processing accuracy.

In FIG. 4B, for the illustrative purposes, the actual axial length of the first rotary shaft 16 is exaggerated and the cutting blades 22 of the first roll 20 are shown in cross-sectional views and side views alternately with the intention of clearly illustrating the spacers 28 and the spacers 128.

In the present embodiment, the projections 21*a* and 121*a* of the retainers 21 and 121 respectively correspond to a controlling portion and a preventing portion.

When the workpiece is fed between the first and second rolls 20 and 40 and is pressed, a shape with multiple projections and multiple recesses in a line is formed continuously in the workpiece W as shown in FIG. 3 with each cutting part 26 of each cutting blade 22 of the first roll 20 and each recess 127 of each cutting blade 122 of the second roll 40 shown in FIGS. 4A and 4B.

In FIG. 3, for illustrative purposes, the outer shapes of the first and second rolls 20 and 40 are shown by the path of the outermost circumference of the cutting parts 26 and that of the cutting parts 126 respectively.

Operation of First Embodiment

Operation of the roll forming device, which has the above described configuration, will now be described.

In the roll forming device of the present embodiment, the first and second rolls 20 and 40 are assembled by the same method. Thus, the following describes how the retainers 21, the cutting blades 22, the spacers 28, and the first rotary shaft 16 of the first roll 20 are assembled. A method of putting the retainers 121, the cutting blades 122, the spacers 128, and the second rotary shaft 18 of the second roll 40 together will be understood by replacing members described relating to the first roll 20 with corresponding members of the second roll 40. Regarding embodiments described below, operation and effect related to only one of rolls are applicable to the other roll.

First, a worker places one end surface of a first retainer 21 on a horizontal plane of a working table (not shown). Specifically, the worker places the opposite end surfaces of the retainer 21 one above the other. In this state, the worker fits the key 25 of FIGS. 4A and 4B into the key groove in the retainer 21. The length of the key 25 is the same as the axial length S of the retainer 21.

Then, the worker fits multiple cutting blades 22 and multiple spacers 28 to the retainer 21 while causing the retainer 21 to pass through the cutting blades 22 and the spacers 28 to stack the cutting blades 22 and the spacers 28 alternately such that the cutting blades 22 and the spacers 28 are aligned along the outer circumferential surface of the retainer 21 and part of the key 25 projecting from this outer circumferential surface, thereby forming a cutting blade group 23.

The number of the cutting blades 22 and that of the spacers 28 forming the cutting blade group 23 are determined such that the cutting blade group 23 falls within the axial length S of the retainer 21. Specifically, the number of the cutting blades 22 and that of the spacers 28 forming the cutting blade group 23 are set such that the thickness of the stack becomes the same as the axial length S or a value slightly smaller than the axial length S.

Meanwhile, when the cutting blades 22 and the spacers 28 are stacked alternately while the retainer 21 is made to pass through the cutting blades 22 and the spacers 28, fine warp of the cutting blades 22 and the spacers 28 and accumulation of tiny gaps may make the thickness of the stack of the cutting blade group 23 greater than the axial length S. In this case, the two projections 21*a* projecting from the end surface of the retainer 21 prevent a cutting blade 22 corresponding to a part beyond the axial length S from falling off.

In a conventional structure, the absence of the projections 21*a* may cause the cutting blade 22 or the spacer 28 to come off the retainer 21.

After forming the cutting blade group 23 on one retainer 21 in the aforementioned method, the worker holds the cutting blade group 23 and the retainer 21 such that the cutting blade group 23 does not come off the opposite end surfaces of the retainer 21 and fits the cutting blade group 23 and the retainer 21 to the vertically arranged first rotary shaft 16 while causing the first rotary shaft 16 to pass through the cutting blade group 23 and the retainer 21. Then, the worker moves the cutting blade group 23 and the retainer 21 until the retainer 21 is locked into one collar 29 (in FIG. 2, the right collar 29) fixed in advance to the first rotary shaft 16. Then, the worker couples the cutting blade group 23 and the retainer 21 to the first rotary shaft 16 with the key 24.

Next, the worker forms respective cutting blade groups 23 on a second retainer 21 and a third retainer 21 in the aforementioned method. Then, the worker fits the second and third retainers 21 and these cutting blade groups 23 sequentially to the first rotary shaft 16 while causing the first rotary shaft 16 to pass through the second and third retainers 21 and the cutting blade groups 23. The worker moves the second and third retainers 21 and the cutting blade groups 23 until a retainer 21 arranged below stops. Then, the worker couples the second and third retainers 21 and the cutting blade groups 23 to the first rotary shaft 16 with the key 24. In doing this, the worker fits the projections 21*a* of a retainer 21 arranged below into the receiving portions 21*b* of a different retainer 21 adjacent to and above the former retainer 21.

Next, the worker fits the collar 29 with the receiving grooves 29*a* to the first rotary shaft 16 such that the first rotary shaft 16 passes through this collar 29. Then, with the projections 21*a* of the top retainer 21 received in place in the receiving grooves 29*a* of this collar 29, the worker presses this collar 29 until it abuts on the top retainer 21. As a result, the cutting blade group 23 on each retainer 21 is compressed to fall within the axial length S of each retainer 21. In this state, the worker fixes this collar 29 to the first rotary shaft 16.

The present embodiment has the following features.

(1) In the roll forming device of the present embodiment, the first and second rolls 20, 40 include the multiple stacked cutting blades 22, 122 and the retainers 21, 121 allowing the first and second rotary shafts 16, 18 to pass through and passing through the multiple stacked cutting blades 22, 122, respectively. End portions of the retainers 21, 121 are provided with the projections 21*a*, 121*a* (controlling portions) to control positioning of the multiple cutting blades 22, 122 while these cutting blades 22, 122 are stacked, respectively. As a result, the roll forming device of the present embodiment achieves the effect of controlling a stacking direction of multiple cutting blades easily with a retainer while the cutting blades in layers are fitted to the retainer.

(2) In the roll forming device of the present embodiment, for stacking the multiple cutting blades 22, 122, the projections 21*a*, 121*a* are used as preventing portions and projecting portions to prevent the cutting blades 22, 122 from coming off the retainers 21, 121, respectively. As a result, in the present embodiment, the cutting blades 22, 122 are prevented from coming off the retainers 21, 121 respectively while these cutting blades 22, 122 are stacked. Thus, the stacking direction is controlled easily with the retainers 21, 121.

(3) In the roll forming device of the present embodiment, the multiple projections 21*a*, 121*a* are provided at end surfaces on one side of the retainers 21, 121, respectively. The projections 21*a*, 121*a* are separated from each other. This enhances the function of preventing separation of the cutting blades 22, 122 from the retainers 21, 121, respectively, during stacking of the cutting blades 22, 122.

(4) The roll forming device of the present embodiment includes the multiple retainers 21, 121 arranged to contact each other. Each projection 21*a*, 121*a* (projecting portion) is formed integrally with an end surface of each retainer 21, 121 and is received in the receiving portion 21*b*, 121*b* of different adjacent retainers 21, 121, respectively. In the present embodiment, each projection 21*a*, 121*a* is received in adjacent receiving portion 21*b*, 121*b*. As a result, the projection 21*a*, 121*a* of each retainer 21, 121 is no hindrance to arrangement of retainers relative to each other.

Second Embodiment

A roll forming device according to a second embodiment will now be described with reference to FIGS. 8 to 10. The same components as those in the first embodiment are given the same reference numerals and description thereof is omitted, and differences from the first embodiment will be described.

Figure 10:
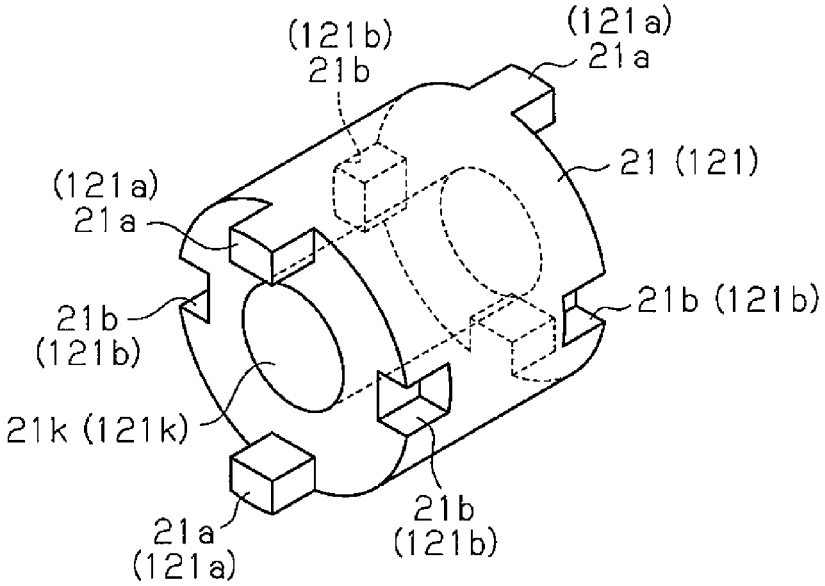
FIG. 10 is a perspective view of the retainer of the second embodiment.

As shown in FIG. 10, the second embodiment differs from the first embodiment in that multiple projections 21*a* and multiple receiving portions 21*b* are provided to each end surface of the retainer 21. The other structures of the second embodiment are the same as those of the first.

The arrangement of the projections 21*a* and the receiving portions 21*b* relative to each other are not limited. The projections 21*a* and the receiving portions 21*b* are simply required to be arranged in a manner that allows the projections 21*a* of one of two adjacent retainers 21 to be received in the receiving portions 21*b* of the other retainer 21. The number of the projections 21*a* at each end surface of the retainer 21 may be one or three or more. Based on the number of the projections 21*a* of one retainer 21, the number of the receiving portions 21*b* of the other adjacent retainer 21 can be determined.

Figure 8:
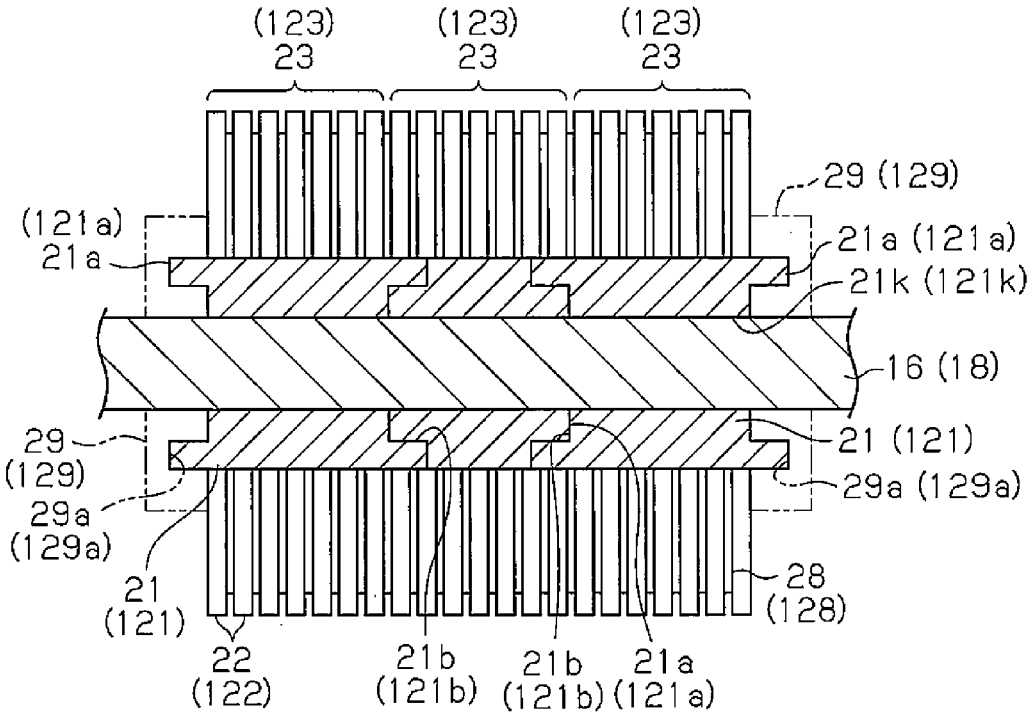
FIG. 8 is a vertical cross-sectional view of a first roll (second roll) according to a second embodiment.
Figure 9:
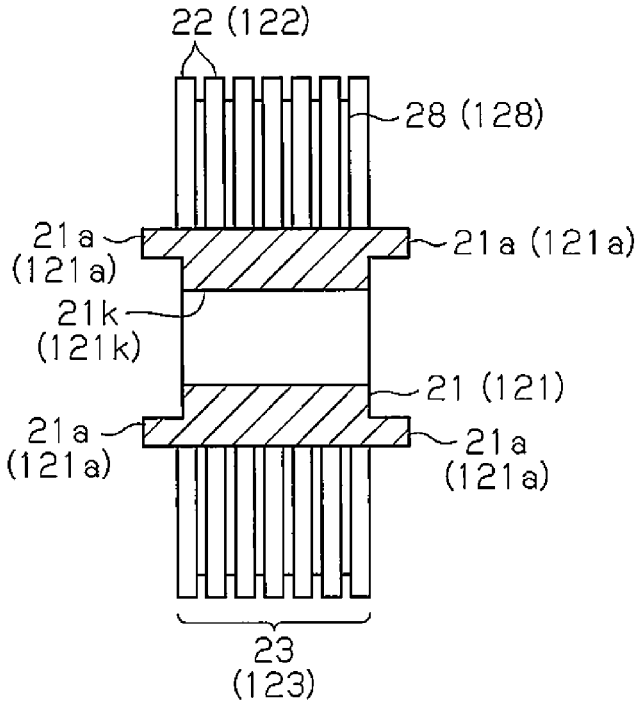
FIG. 9 is a schematic cross-sectional view of a retainer and cutting blades of the second embodiment.

As shown in FIG. 8, the second embodiment differs from the first embodiment in that the two collars 29 are each provided with the receiving groove 29*a* to receive the projection 21*a* of the retainer 21.

The second embodiment of the aforementioned structure achieves the advantages (1) to (4) of the first embodiment.

Third Embodiment

A roll forming device according to a third embodiment will now be described with reference to FIGS. 11 to 13. The third embodiment differs from the first embodiment in that a movable projection 21*c* is provided at one end surface of the retainer 21 instead of the projection 21*a* of the first embodiment and an opposite end surface of the retainer 21 is flat without the receiving portion 21*b*. The other structures of the third embodiment are the same as those of the first embodiment. The movable projection 21*c* corresponds to a controlling portion, a preventing portion, and a projecting portion.

The third embodiment further differs from the first embodiment in that it uses a collar 29 without the receiving groove 29*a* instead of the collar 29 with the receiving groove 29*a*.

Figure 13A:
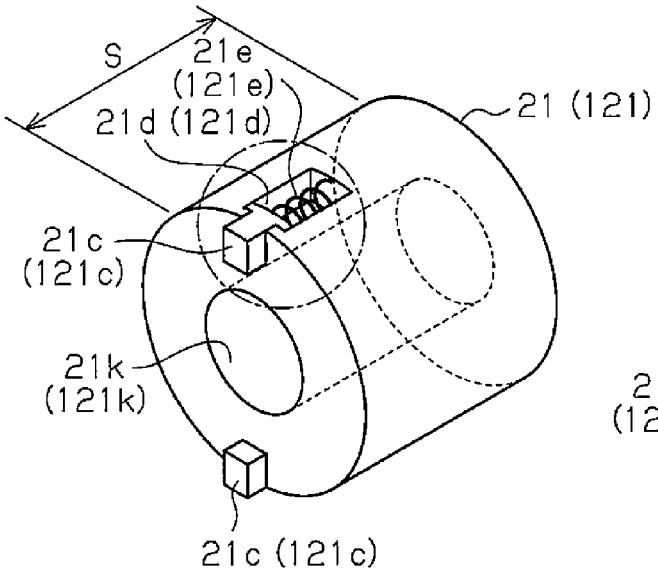
FIG. 13A is a perspective view of the retainer of the third embodiment.
Figure 13B:
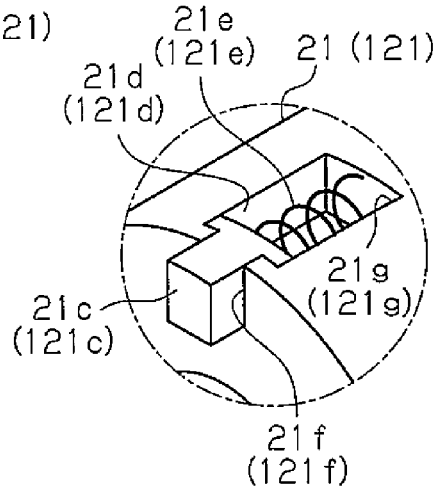
FIG. 13B is an enlarged view showing a principal part of the retainer of the third embodiment.

As shown in FIG. 13A, a receiving recess 21*d* extending from one end surface of the retainer 21 in the direction of the axial length is formed in the outer circumferential surface of the retainer 21. The projection 21*a*, 121*a* is received in the receiving recess 21*d* such that it can move in the direction of the axial length. As shown in FIG. 13B, the receiving recess 21*d* is formed of an opening part 21*f* forming an opening at an end surface of the retainer 21 and a back part 21*g* communicating with the opening part 21*f*. The opening part 21*f* is formed to have a narrow width while the back part 21*g* is formed to have a wide width. The movable projection 21*c* is formed to have a wide width at a base end portion and a narrow width at a tip portion, so that the movable projection 21*c* is formed into a T shape as a whole.

As shown in FIG. 13B, the movable projection 21*c* is arranged such that its base end portion and its tip portion are slidable in the back part 21*g* and the opening part 21*f* respectively. The back part 21*g* receives an elastic member 21*e* between the inner surface of the back part 21*g* and the base end portion of the movable projection 21*c*. The urging force of the elastic member 21*e* locks the base end portion of the movable projection 21*c* into a step in the opening part 21*f* facing the bottom surface of the back part 21*g*, thereby holding the movable projection 21*c* with the tip portion thereof projecting from the opening part 21*f*. The tip portion of the movable projection 21*c* projects the same length as the projection 21*a* of the first embodiment.

By pressing the movable projection 21*c* against the urging force of the elastic member 21*e* toward the back part 21*g*, the movable projection 21*c* can be retracted to a position flush with the end surface of the retainer 21. The elastic member 21*e* is formed of a coil spring. Alternatively, a plate spring, a disc spring, rubber, or an air spring may be used as the elastic member 21*e*, for example.

Operation of Third Embodiment

Figure 12:
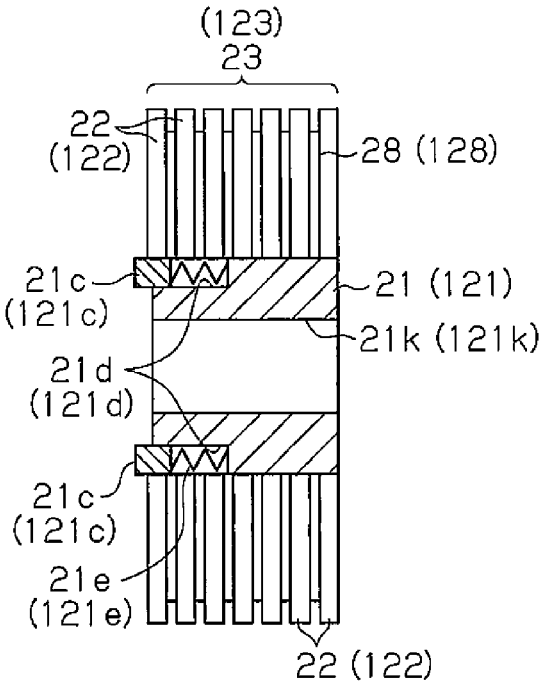
FIG. 12 is a schematic cross-sectional view of a retainer and cutting blades of the third embodiment.

As shown in FIG. 12, regarding the roll forming device of the aforementioned structure, the cutting blade group 23 is assembled to each retainer 21 with the movable projection 21*c* projecting from the end surface of the retainer 21.

When multiple cutting blades 22 and multiple spacers 28 are stacked alternately while the retainer 21 is made to pass through the cutting blades 22 and the spacers 28, fine warp of the cutting blades 22 and the spacers 28 and accumulation of tiny gaps may make the thickness of the stack of the cutting blade group 23 greater than the axial length S as in the first embodiment. In this case, the two movable projections 21*c* projecting from the end surface of the retainer 21 prevent coming off a cutting blade 22 corresponding to a part beyond the axial length S from coming off.

After assembling the cutting blade group 23 on a first retainer 21, a worker holds the cutting blade group 23 and the retainer 21 such that the cutting blade group 23 does not come off the opposite end surfaces of the retainer 21 and fits the cutting blade group 23 and the retainer 21 to the vertically arranged first rotary shaft 16 while causing the first rotary shaft 16 to pass through the cutting blade group 23 and the retainer 21. Then, the worker moves the cutting blade group 23 and the retainer 21 until the retainer 21 is locked into one collar 29 fixed in advance to the first rotary shaft 16. Then, the worker couples the cutting blade group 23 and the retainer 21 to the first rotary shaft 16 with the key 24.

Figure 11:
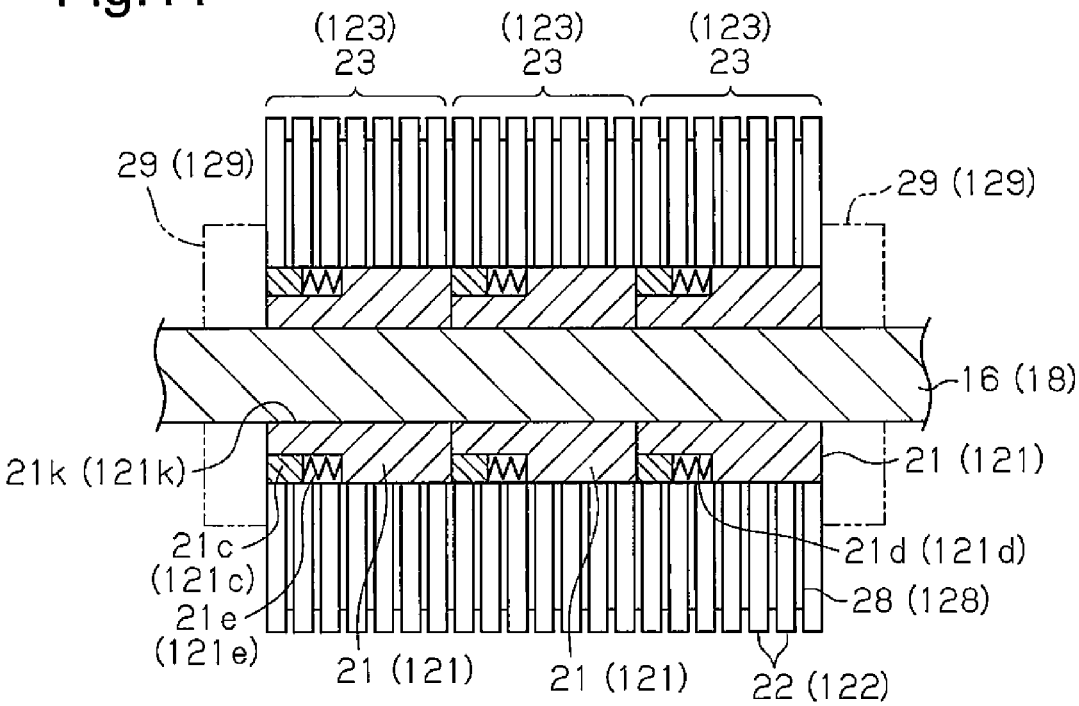
FIG. 11 is a vertical cross-sectional view of a first roll (second roll) according to a third embodiment.

As clearly shown in FIG. 11, like in the first embodiment, the worker thereafter forms respective cutting blade groups 23 on a second retainer 21 and a third retainer 21. Then, the worker fits the second and third cutting blade groups 23 and the retainers 21 sequentially to the first rotary shaft 16 while causing the first rotary shaft 16 to pass through the second and third cutting blade groups 23 and the retainers 21. When a retainer 21 arranged below stops moving, the worker couples the second and third cutting blade groups 23 and the retainers 21 to the first rotary shaft 16 with the key 24.

In doing this, as clearly shown in FIG. 11, the worker presses the movable projection 21*c* of the retainer 21 arranged below toward the back part 21*g* with an end surface of a different retainer 21 adjacent to and above the former retainer 21 against the urging force of the elastic member

21*e*, thereby causing the movable projection 21*c* to be retracted to a position flush with the end surface of the retainer 21. Then, the worker fits the collar 29 without the receiving grooves 29*a* to the first rotary shaft 16 such that the first rotary shaft 16 passes through this collar 29. Then, the worker presses the movable projection 21*c* of the top retainer 21 with this collar 29 to press this movable projection 21*c* toward the back part 21*g* against the urging force of the elastic member 21*e*, thereby causing this movable projection 21*c* to be retracted to a position flush with the end surface of the retainer 21. As a result, the cutting blade group 23 on each retainer 21 is compressed to fall within the axial length S of each retainer 21. In this state, the worker fixes this collar 29 to the first rotary shaft 16.

The present embodiment achieves the following advantage as well as the advantages (1) to (4) of the first embodiment.

(5) The roll forming device of the third embodiment includes the multiple retainers 21, 121 arranged to be adjacent to each other. The movable projections 21*c*, 121*c* form a projecting portion and are supported such that each movable projection 21*c*, 121*c* can project from an end surface of the retainers 21, 121, respectively. While the retainers 21, 121 are adjacent to each other, the movable projection 21*c*, 121*c* of one of the retainers 21, 121 is pressed with the other adjacent retainer 21, 121 to be received in the former retainer 21, 121.

As a result, the third embodiment eliminates the need for forming space in the collars 29 and 129 to receive a projecting portion, so that the structure of the collar simplified as that of a general-purpose collar.

Fourth Embodiment

A roll forming device according to a fourth embodiment will now be described with reference to FIGS. 14 to 18.

Figure 14:
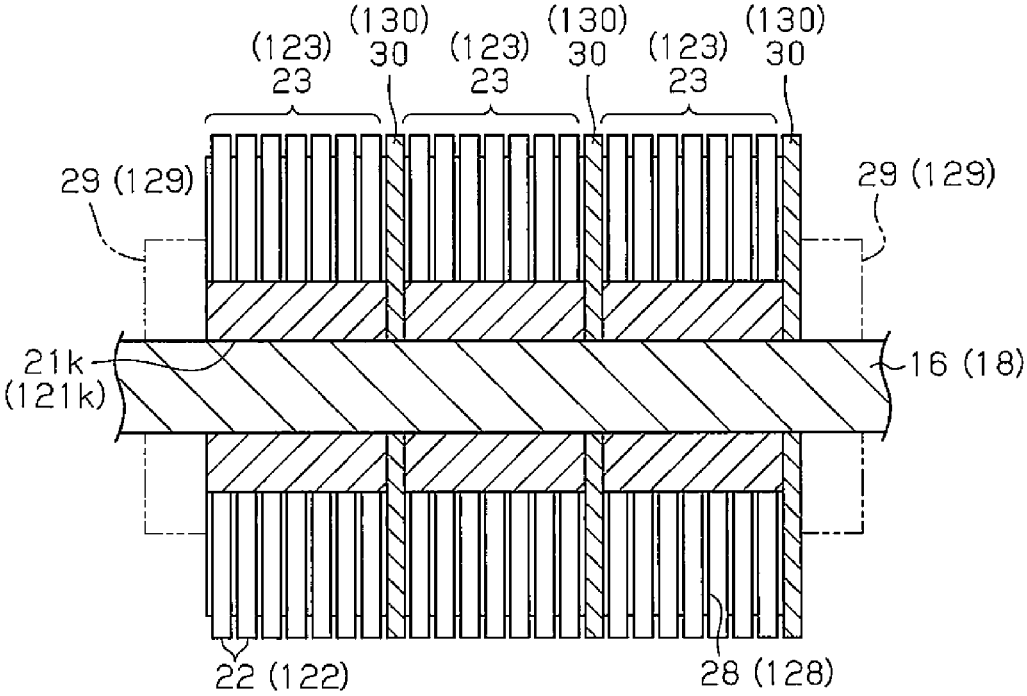
FIG. 14 is a vertical cross-sectional view of a first roll (second roll) according to a fourth embodiment.
Figure 15:
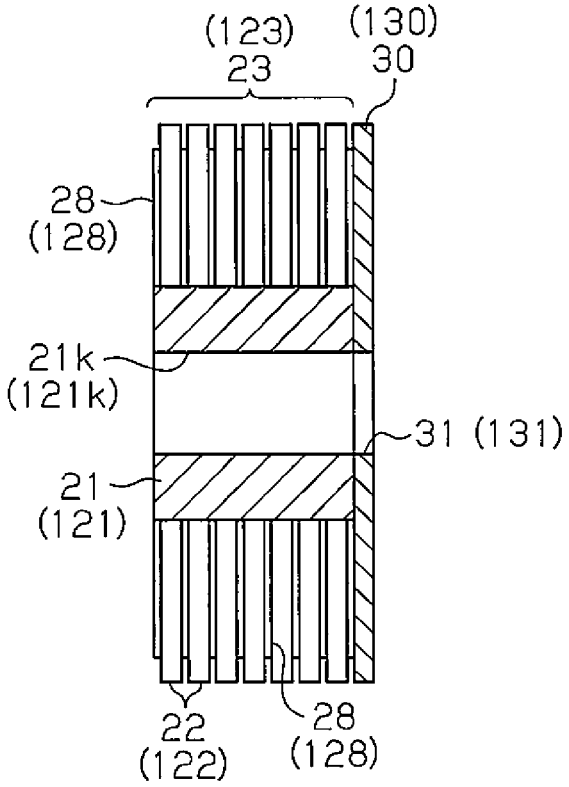
FIG. 15 is a schematic cross-sectional view of a retainer and cutting blades of the fourth embodiment.

As shown in FIGS. 14 and 15, the projections 21*a*, 121*a*, the receiving portions 21*b*, 121*b* of the retainers 21, 121, and the receiving grooves 29*a*, 129*a* of the collars 29, 129, which form the structure of the first embodiment, are omitted in the fourth embodiment. Instead, in the fourth embodiment, a position controlling cutting blade 30, 130 is provided between two adjacent retainers 21, 121, respectively. The position controlling cutting blade 30, 130 corresponds to a controlling portion.

Figure 16:
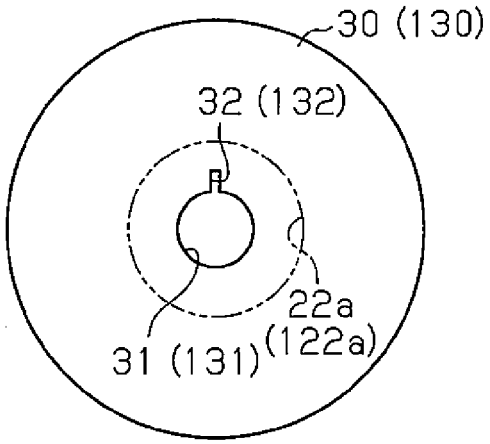
FIG. 16 is a side view of a position controlling cutting blade of the fourth embodiment.

As shown in FIG. 16, each of the position controlling cutting blades 30, 130 is formed into a substantially circular shape and has cutting parts and recesses (not shown) along the outer circumference thereof as those of each of the cutting blades 22, 122. The outer shape of the position controlling cutting blades 30, 130 is the same as that of the cutting blade 22. The position controlling cutting blades 30, 130 have shaft holes 31, 131 respectively that allow the first rotary shaft 16 to pass through. The inner diameters of the shaft holes 31, 131 are set to be the same as the outer diameters of the first and second rotary shafts 16, 18, respectively, such that the first and second rotary shafts 16, 18 pass through the shaft holes 31, 131 directly without the interventions of the retainers 21, 121, respectively. As shown in FIG. 16, a key groove 32, 132 is formed in the shaft hole 31, 131 and allows the keys 24, 124 of FIGS. 4A and 4B to pass through, respectively. A long dashed double-short dashed line of FIG. 16 shows an attachment hole 22*a*, 122*a* that allow the retainers 21, 121 for the cutting blades 22, 122 to pass through, respectively.

In the fourth embodiment, each of the position controlling cutting blades 30 and 130 is simply held between two adjacent retainers 21, 121.

Operation of Fourth Embodiment

Regarding the roll forming device of the aforementioned structure, the position controlling cutting blade 30, 130 is held between the retainers 21, 121, respectively. This prevents movement of the cutting blades 22, 122 on one of adjacent retainers 21, 121 toward the other retainer 21, 121 with the position controlling cutting blade 30, 130.

Figure 17:
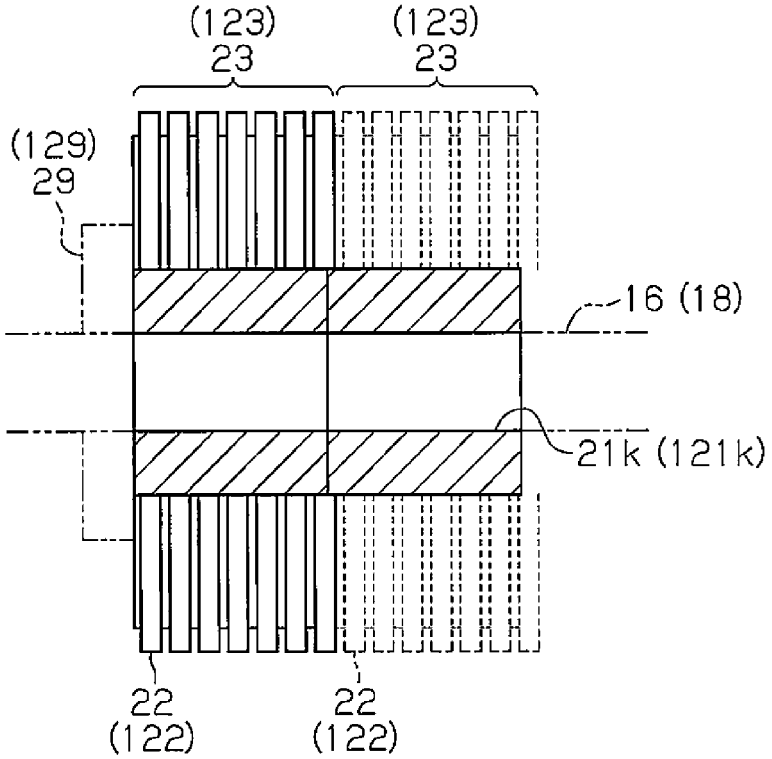
FIG. 17 is a vertical cross-sectional view of a conventional retainer and cutting blades.

FIG. 17 shows an example where the position controlling cutting blades 30, 130 are not provided between the retainers 21, 121, respectively.

Figure 18:
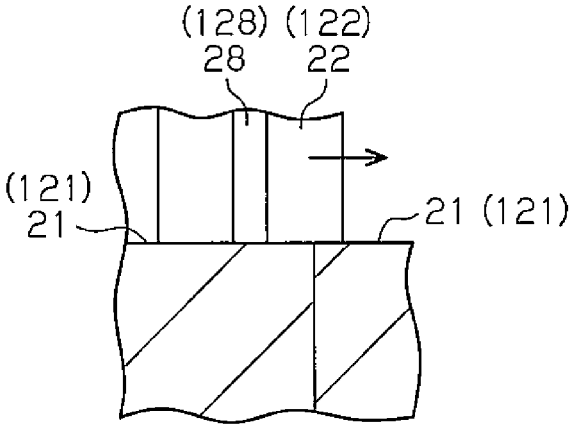
FIG. 18 is an enlarged vertical cross-sectional view showing a principal part of the conventional retainer and cutting blades.

The thickness of the stack of the cutting blade group 23, 123 needs to be controlled for each retainer 21, 121, respectively. Meanwhile, in the absence of the position controlling cutting blades 30, 130, the cutting blades 22, 122 on one of adjacent retainers 21, 121 may move toward the other retainer 21, 121 as shown in FIG. 18. This disables control of the thickness of the stack of the cutting blade group 23 for each retainer 21.

The fourth embodiment achieves the following advantage.

(1) The roll forming device of the present embodiment includes the multiple retainers 21, 121 arranged to be adjacent to each other. The position controlling cutting blades 30, 130 each functioning as a controlling portion are located between the retainers 21, 121, respectively, to restrict the positions of the multiple cutting blades 22, 122 on the retainers 21, 121. As a result, in addition to the advantage (1) of the first embodiment, the fourth embodiment achieves an advantage of preventing movement of a cutting blade between adjacent retainers, making it possible to control the thickness of a stack of a cutting blade group strictly for each retainer 21, 121.

Fifth Embodiment

Figure 19:
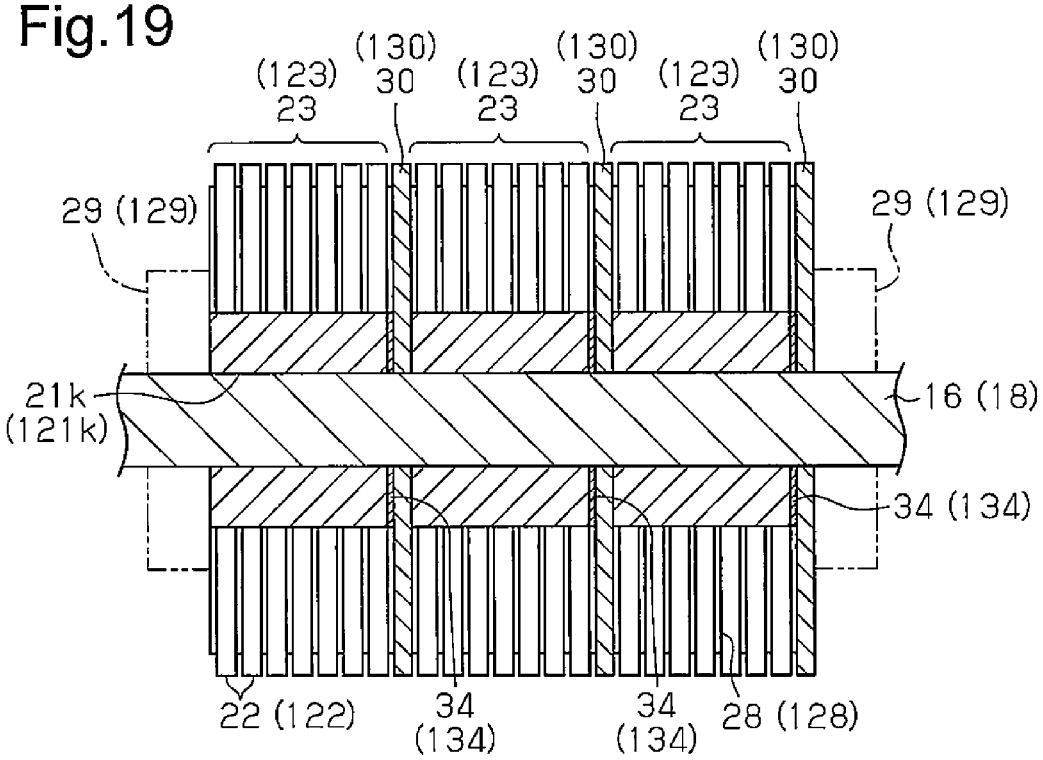
FIG. 19 is a vertical cross-sectional view of a first roll (second roll) according to a fifth embodiment.
Figure 20:
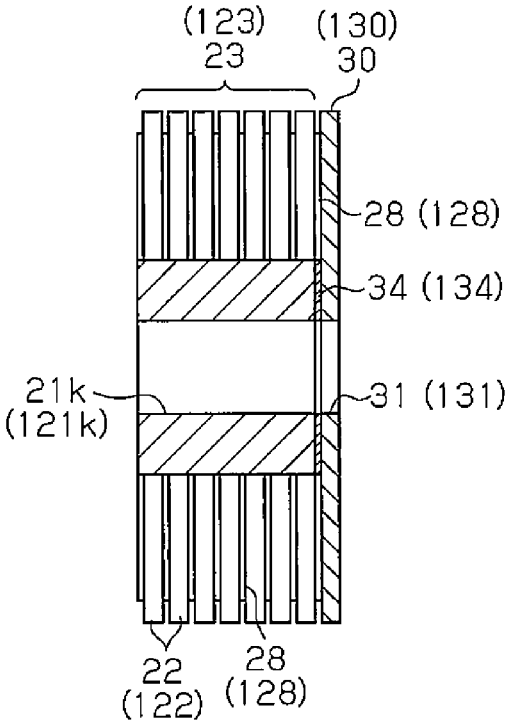
FIG. 20 is a schematic cross-sectional view of a retainer and cutting blades of the fifth embodiment.

A roll forming device according to a fifth embodiment will now be described with reference to FIGS. 19 and 20.

According to the structure of the fourth embodiment, the position controlling cutting blade 30 is simply held between the retainers 21. The firth embodiment differs from the fourth embodiment in that the position controlling cutting blade 30 is fixed with an adhesive 34, 134 to an end surface of one of the retainers 21.

Fixing the position controlling cutting blades 30, 130 in this way to the retainers 21, 121, respectively, works advantageously when the cutting blade groups 23, 123 are thereafter mounted on the retainers 21, 121, respectively, and then the retainers 21, 121 are attached to the first and second rotary shafts 16, 18 while the first and second rotary shafts 16, 18 are made to pass through the retainers 21, 121, respectively. In this case, the presence of the position controlling cutting blades 30, 130 fixed to one end surface of the retainer 21, 121 prevents the cutting blades 22, 122 from coming off this end surface of the retainer 21, 121, respectively. Thus, a worker is required only to hold the retainer 21 to prevent the cutting blades 22 from coming off an opposite end surface. This facilitates control of the cutting blade groups 23, 123 fitted on the retainers 21, 121 respectively.

Sixth Embodiment

In the fifth embodiment, respective end surfaces of the retainers 21, 121 are made to be flat and the position controlling cutting blades 30, 130 are fixed to the end surfaces of the retainers 21, 121 with the adhesive 34, 134, respectively.

Figure 21:
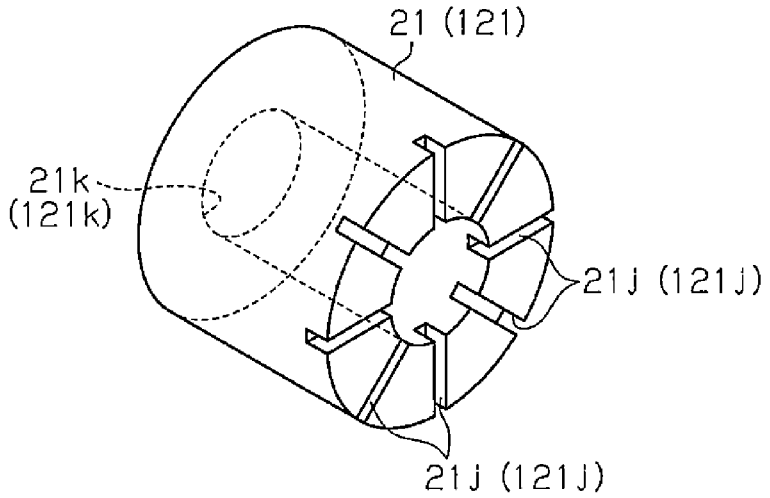
FIG. 21 is a perspective view of a retainer according to a sixth embodiment.

In contrast, in a sixth embodiment, multiple recesses 21*j*, 121*j* arranged in a radial pattern in the end surfaces of the retainers 21, 121, respectively, are added to the structure of the fifth embodiment as shown in FIG. 21. The recesses 21*j*, 121*j* are provided for a residue of the adhesive 34, 134 to escape into the recesses 21*j*, 121*j*, respectively, while the position controlling cutting blades 30, 130 are adhered with the adhesive 34, 134, respectively. This structure of the sixth embodiment allows the residues of the adhesive 34, 134 to escape into the recesses 21*j*, 121*j* respectively. This reduces an error that is likely to occur in the thickness of the adhesive layer formed of the adhesive 34, 134 between the position controlling cutting blade 30, 130 and the end surface of the retainer 21, 121.

In the sixth embodiment, the multiple recesses 21*j*, 121*j* are arranged in a radial pattern extending from the cores of retainers 21, 121 respectively. However, the shape of the recesses is not limited. As an example, the recesses may be arranged in a ring pattern extending along a circle coaxial with the core, formed as dimples, or arranged in a lattice pattern.

Seventh Embodiment

A roll forming device according to a seventh embodiment will now be described.

In the fifth embodiment, the position controlling cutting blades 30, 130 are fixed to an end surface of a corresponding retainer 21, 121 with the adhesive 34, 134, respectively. The seventh embodiment differs from the fifth embodiment in that the position controlling cutting blades 30, 130 are fixed to an end surface of a corresponding retainer 21, 121 with multiple screws 42, 142, respectively.

Figure 22:
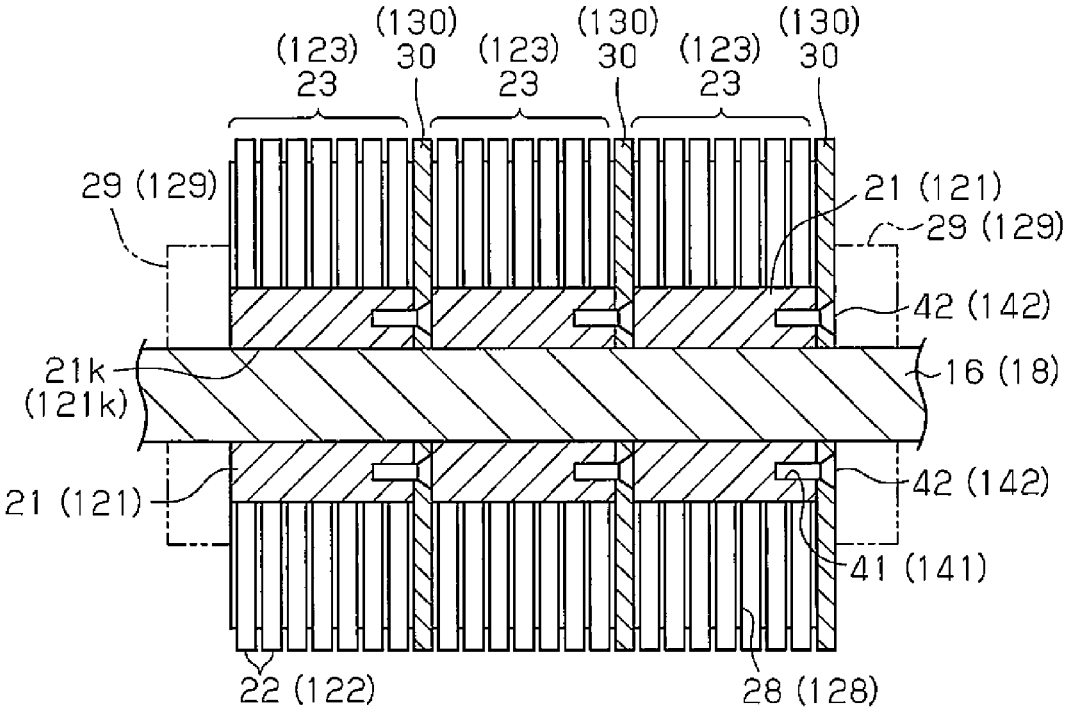
FIG. 22 is a vertical cross-sectional view of a first roll (second roll) according to a seventh embodiment.
Figure 23:
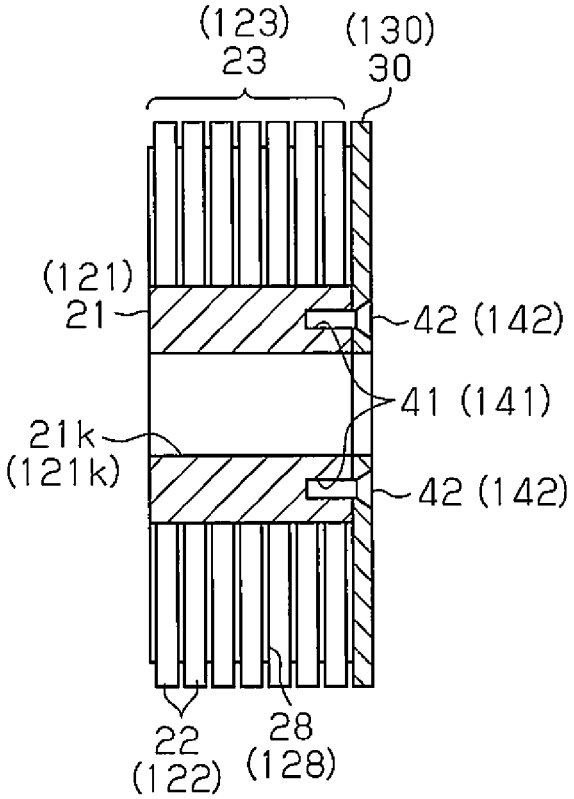
FIG. 23 is a schematic cross-sectional view of a retainer and cutting blades of the seventh embodiment.
Figure 24:
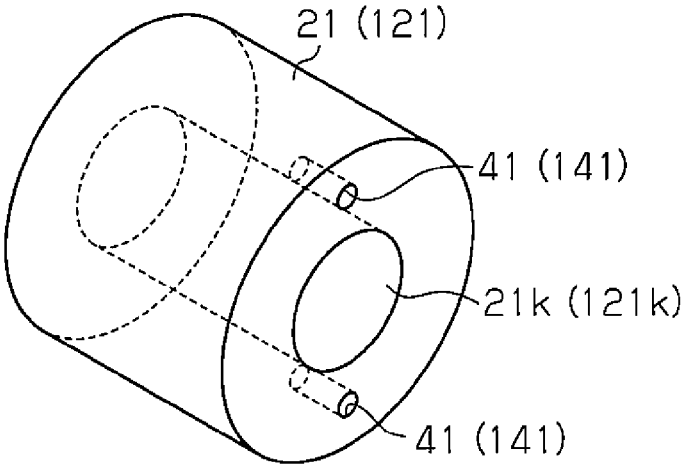
FIG. 24 is a perspective view of the retainer of the seventh embodiment.

As shown in FIGS. 22 to 24, multiple internal thread holes 41, 141 are formed in an end surface of each retainer 21, 121, respectively. The position controlling cutting blades 30, 130 are fastened and fixed to each retainer 21, 121 with the screws 42, 142 respectively as fastening members to be threaded into the internal thread holes 41, 141, respectively. The number of the internal thread holes 41, 141 is two. However, these numbers may be three or more. It is preferable that the multiple internal thread holes be arranged at a regular pitch.

An end surface of the head of each screw 42, 142 are arranged to be flush with a side surface of each position controlling cutting blade 30, 130, respectively. Thus, a receiving recess for receiving the head of each screw 42, 142 are not required to be formed in one of opposite side surfaces of each collar 29, 129 facing the position controlling cutting blades 30, 130, respectively.

Eighth Embodiment

Figure 25:
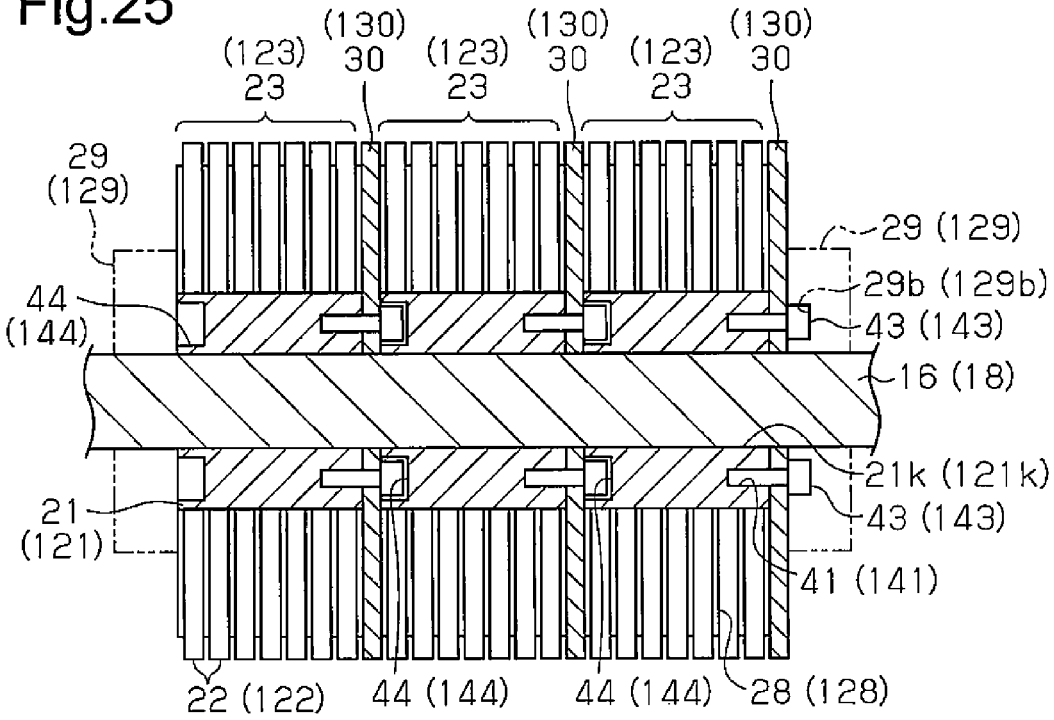
FIG. 25 is a vertical cross-sectional view of a first roll (second roll) according to an eighth embodiment.
Figure 26:
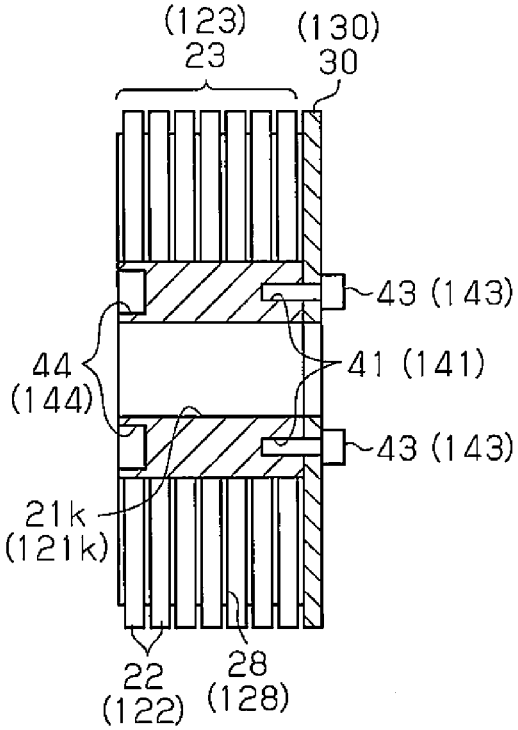
FIG. 26 is a schematic cross-sectional view of a retainer and cutting blades of the eighth embodiment.
Figure 27:
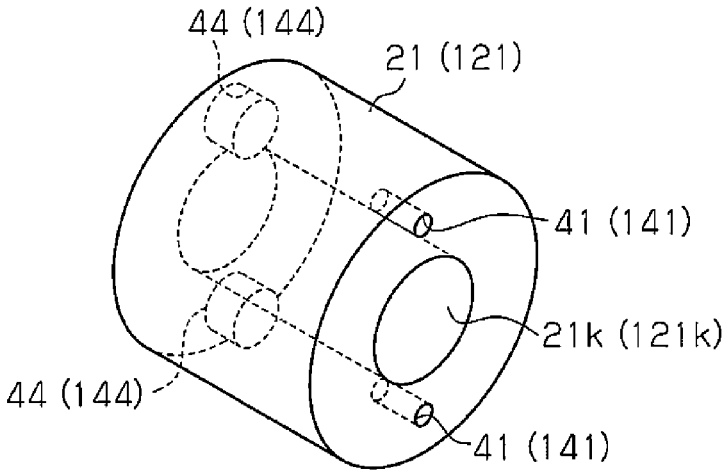
FIG. 27 is a perspective view of the retainer of the eighth embodiment.

With reference to FIGS. 25 to 27, differences of a roll forming device according to an eighth embodiment from the seventh embodiment will be described.

The eighth embodiment differs from the seventh embodiment in that each position controlling cutting blade 30, 130 is fixed to an end surface of a corresponding retainer 21, 121 with a bolt 43, 143 threaded into each internal thread hole 41, 141, respectively, and that the head of each bolt 43, 143 projects from a side surface of the position controlling cutting blade 30, 130, respectively. In the eighth embodiment, the head of the bolt 43, 143 projecting from the side surface of the position controlling cutting blade 30, 130 is received in a head receiving portion 44, 144 formed as a recess in the end surfaces of the retainer 21, 121, respectively. Each head receiving portion 44, 144 is formed into a circular shape in cross section like a countersink, for example. However, the shape of the head receiving portion 44, 144 is not limited thereto. Each bolt 43, 143 corresponds to a fastening member.

As shown in FIG. 25, a side surface of each collar 29, 129 facing the head of each bolt 43, 143 is provided with a receiving recess 29*b*, 129*b*, respectively. Like the head receiving portion 44, 144, the receiving recess 29*b*, 129*b* receives the head of each bolt 43,*t* 143, respectively.

In the eighth embodiment, the position controlling cutting blade 30, 130 can be fixed to the end surface of the retainer 21, 121 with each bolt 43, 143, respectively.

Ninth Embodiment

Figure 28:
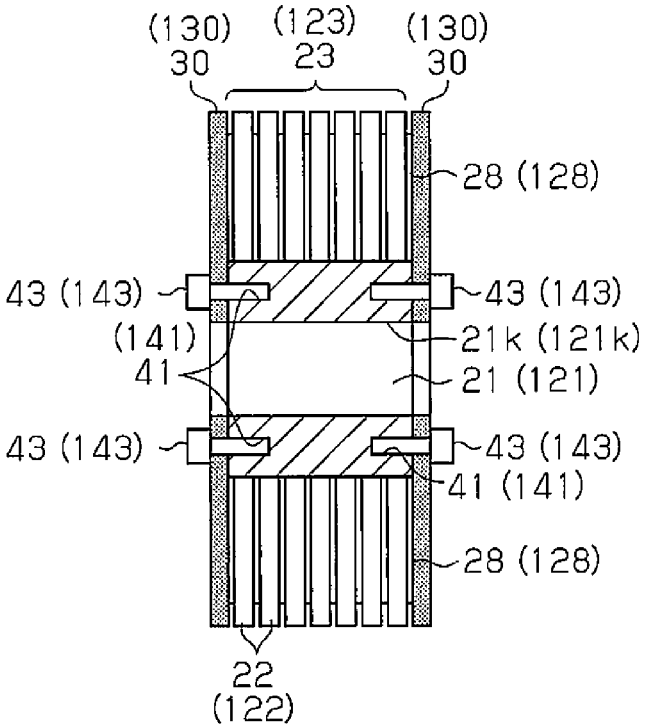
FIG. 28 is a vertical cross-sectional view of a first roll (second roll) according to a ninth embodiment.
Figure 29:
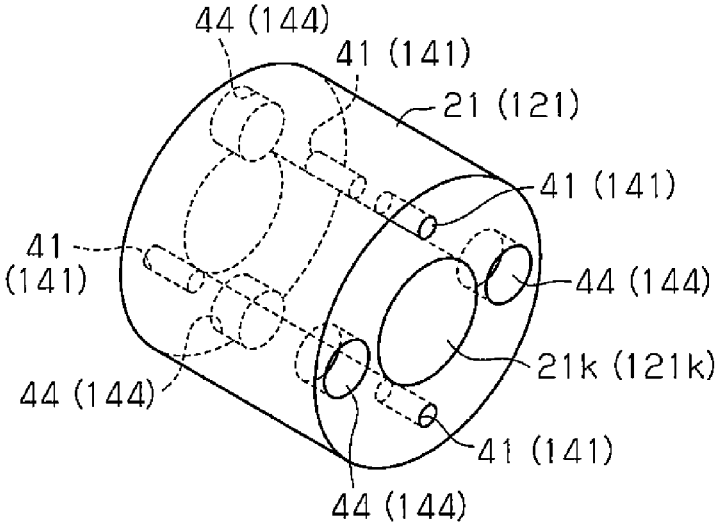
FIG. 29 is a perspective view of a retainer of the ninth embodiment.

With reference to FIGS. 28 and 29, differences of a roll forming device according to a ninth embodiment from the eighth embodiment will be described.

As shown in FIG. 28, in the ninth embodiment, a pair of position controlling cutting blades 30, 130 fixed to opposite end surfaces of each retainer 21, 121 is added to the structure of the eighth embodiment. Specifically, as shown in FIG. 29, multiple head receiving portions 44, 144 and multiple internal thread holes 41, 141 are formed in each of opposite end surfaces of each retainer 21, 121.

Each position controlling cutting blade 30, 130 (for the illustrative purposes, these cutting blades are referred to as a first position controlling cutting blade) are provided at each of opposite end surfaces of a particular retainer. The first position controlling cutting blade is provided with a through hole (not shown). The head of a bolt for a position controlling cutting blade provided to an adjacent retainer passes through the through hole (not shown) of the first position controlling cutting blade and the head of this bolt is received in the head receiving portion 44, 144 of the retainer 21, 121 to which the first position controlling cutting blade is fixed. In this way, the position controlling cutting blades 30, 130 are fixed to opposite end surfaces of the retainer 21, 121. As a result, an assembly including cutting blades and retainers put together can be handled easily and a stacking direction of multiple cutting blades can be controlled easily with a retainer while the cutting blades in layers are fitted to the retainer.

Tenth Embodiment

A roll forming device of a tenth embodiment will now be described by referring to FIGS. 30 to 32. The tenth embodiment corresponds to a combination of the first and fourth embodiments.

Figure 32:
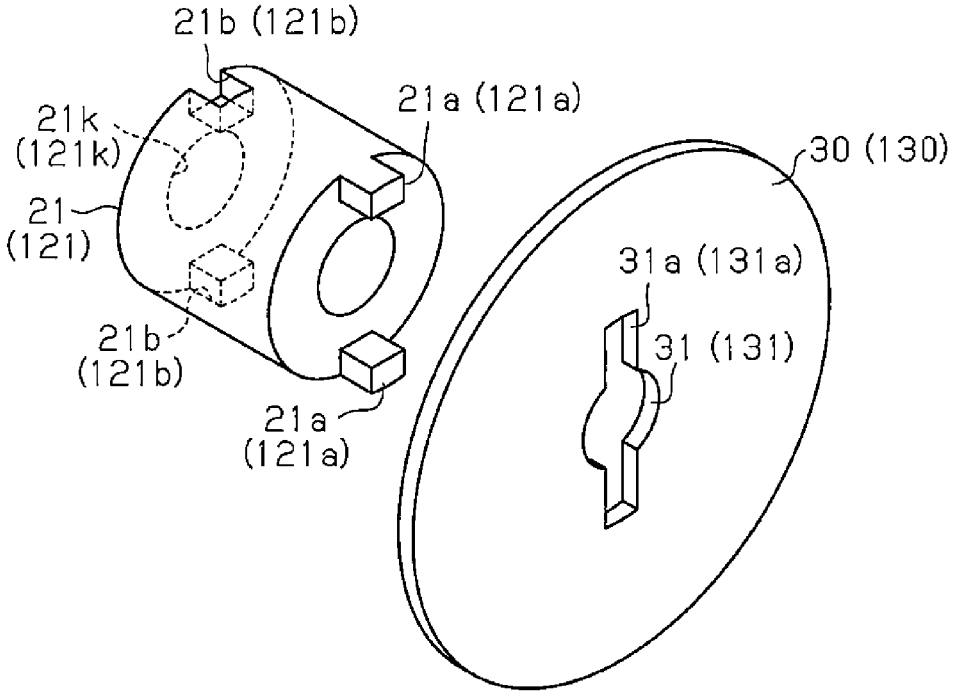
FIG. 32 is a perspective view of the retainer of the tenth embodiment.

As shown in FIG. 32, multiple projections 21*a*, 121*a* and multiple receiving portions 21*b*, 121*b* are provided at one and the other of opposite end surfaces of each retainer 21, 121.

Figure 30:
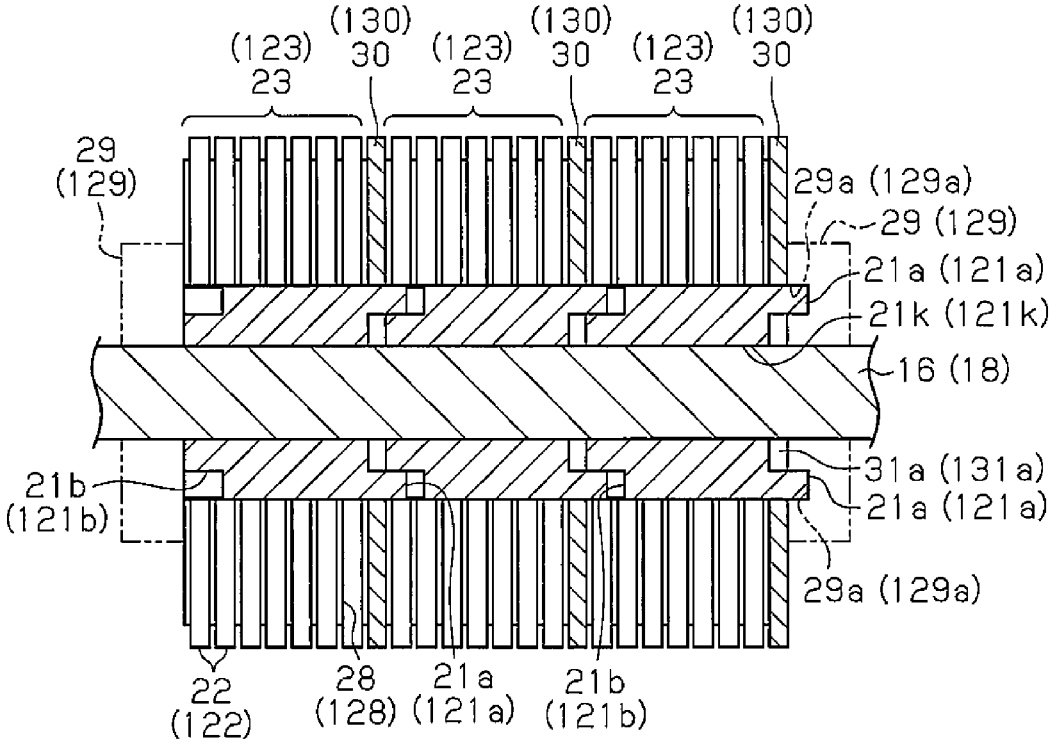
FIG. 30 is a vertical cross-sectional view of a first roll (second roll) according to a tenth embodiment.
Figure 31:
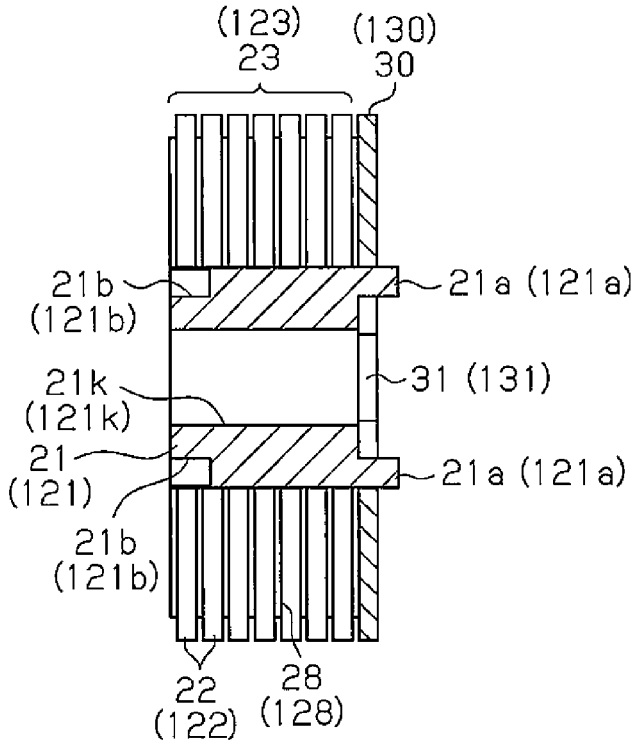
FIG. 31 is a schematic cross-sectional view of a retainer and cutting blades of the tenth embodiment.

As shown in FIGS. 30 to 32, the shaft hole 31, 131 of each position controlling cutting blade 30, 130 has multiple grooves 31*a*, 131*a*. Each projection 21*a*, 121*a* of one retainer 21, 121 passes through a corresponding groove 31*a*, 131*a* to be received in a corresponding receiving portion 21*b*, 121*b* of a different adjacent retainer 21, 121.

The tenth embodiment achieves the advantages of the first and fourth embodiments simultaneously. The tenth embodiment may be modified ton have a combination of the first and fifth embodiments.

The present invention is not limited to the aforementioned embodiments but may be modified as follows.

In the fourth to eighth embodiments, each position controlling cutting blade 30, 130 is fixed to one end surface of each retainer 21, 121. Alternatively, the position controlling cutting blade 30, 130 may be fixed to both of opposite end surfaces of each retainer 21, 121 by the method of each embodiment. Although not illustrated, a spacer 28, 128 having the same inner diameter as that of each position controlling cutting blade 30, 130 may be fixed to one or both of opposite end surfaces of each position controlling cutting blade 30, 130 by the method of each embodiment.

The spacers 28, 128 provided in the aforementioned embodiments may be replaced by a boss part projecting from the retainer 21, 121, respectively.

The invention claimed is:

1. A roll forming device comprising a plurality of stacked cutting blades, wherein the roll forming device roll-forms a workpiece by rotating a pair of rolls each attached to corresponding one of a pair of rotary shafts, each of the rolls includes a corresponding number of the stacked cutting blades, and a retainer, which allows the corresponding rotary shaft to pass through and extends through the cutting blades, the retainer is one of a plurality of retainers adjacent to each other, and each of the retainers has at an end portion a controlling portion for controlling positioning of the cutting blades during stacking of the cutting blades, wherein the controlling portion includes a plurality of movable projections supported in a manner that allow the movable projections to project from an end surface of each retainer, and when the retainers are adjacent to each other, each movable projection is pressed by an adjacent retainer and be received in the associated retainer.

2. The roll forming device according to claim 1, wherein the movable projections are configured to project from the end surface of each retainer during stacking of the cutting blades.

3. The roll forming device according to claim 2, wherein the movable projections are located to be separated from each other.

* * * * *